United States Patent [19]

Vignon

[11] Patent Number: 4,633,663

[45] Date of Patent: Jan. 6, 1987

[54] TWIST GENERATOR FOR A RUNNING FIBER AGGREGATE

[75] Inventor: Louis Vignon, Geneva, Switzerland

[73] Assignee: Heberlein Hispano S.A., Vernier, Switzerland

[21] Appl. No.: 747,791

[22] Filed: Jun. 21, 1985

[30] Foreign Application Priority Data

Jun. 22, 1984 [CH] Switzerland ..... 3024/84

[51] Int. Cl.[4] ..... D02G 1/08

[52] U.S. Cl. ..... 57/340; 57/339; 57/348

[58] Field of Search ..... 57/334, 336, 337-340, 57/348

[56] References Cited

U.S. PATENT DOCUMENTS

| | | | |
|---|---|---|---|
| 4,370,851 | 2/1983 | Oberstrass | 57/340 |
| 4,370,853 | 2/1983 | Bauer et al. | 57/340 |
| 4,377,932 | 3/1983 | Dammann et al. | 57/336 |
| 4,383,405 | 5/1983 | Bauer et al. | 57/340 |
| 4,400,931 | 8/1983 | Maeda | 57/336 |
| 4,408,449 | 10/1983 | Bauer et al. | 57/340 |
| 4,519,204 | 5/1985 | Dammann et al. | 57/340 |

FOREIGN PATENT DOCUMENTS

| | | |
|---|---|---|
| 3123670 | 9/1982 | Fed. Rep. of Germany . |
| 2493882 | 5/1982 | France . |

*Primary Examiner*—John Petrakes

*Attorney, Agent, or Firm*—Young & Thompson

[57] ABSTRACT

A twist generator for a running fiber aggregate possesses two friction discs rotating in opposite directions and having end faces turned towards one another for the twisting of the fiber aggregate running between the friction discs. One friction disc is made flexible and is pressed by pressure rollers towards the end face of the other friction disc and consequently against the fiber aggregate. To allow defined conditions to be obtained as regards pressing force, there are two pressure rollers, of which one is arranged shortly before and the other shortly after the thread contact point of the friction discs in the direction of movement of the flexible friction disc. The two pressure rollers are mounted next to one another, but preferably offset in the direction of movement of the fiber aggregate, on a carrier which is pivotably fastened to a spring-loaded lever. The distribution of the pressing force to the two pressure rollers can be changed by adjusting the carrier relative to this lever.

11 Claims, 3 Drawing Figures

TWIST GENERATOR FOR A RUNNING FIBER AGGREGATE

Twist generators, by means of which a twist or false twist can be imparted to a running fiber aggregate, for example a yarn, a multifilament or a fiber slubbing, are known in many different designs. For example, there are known twist generators with two friction discs rotatable in opposite directions and having end faces turned towards one another for the twisting of a fiber aggregate running between the friction discs and touching the two end faces. In these twist generators, it is difficult to meter the force with which the two friction discs are pressed against the fiber aggregate at the thread contact point. The force must have a certain minimum value to guarantee the frictional take-up of the fiber aggregate. However, when the force is too high, excessive friction arises directly between the end faces of the friction discs which rotate in opposite directions and which are usually provided with elastomeric friction linings. To allow better metering of the pressing force, it has been proposed to make one of the two friction discs flexible and press it against the other friction disc at the thread contact point by means of a spring-loaded pressure roller. However, this arrangement too is unsatisfactory. Instability in the thread run and uneven twisting can occur.

The object of the present invention is to provide a twist generator in which such instability and unevenness can be avoided.

The object is achieved, according to the invention, by providing first and second pressure rollers in contact with a flexible friction disc respectively before and after the thread contact point of the friction discs in the direction of movement of the flexible friction disc. The two pressure rollers are under a spring load for pressing the flexible friction disc towards the end face of the other friction disc, and means are provided for adjusting the distribution of the total pressing force to the two rollers.

Although it would indeed be possible to assay to guide the two pressure rollers so that they are separately movable towards the flexible friction disc and away from it and to provide each of them with its own spring load, the two pressure rollers are preferably carried by a common element, especially a pivotably mounted lever, spring-loaded in the direction of the flexible friction disc, and are adjustable relative to this element. At the same time, the pressure rollers can appropriately be mounted on a carrier which is held pivotably on the spring-loaded element. Such a construction is not only particularly simple, but also allows very accurate adjustment of the distribution of the total pressing force.

A preferred embodiment of the twist generator according to the invention is illustrated diagrammatically in the accompanying drawing in which.

Figure 1:
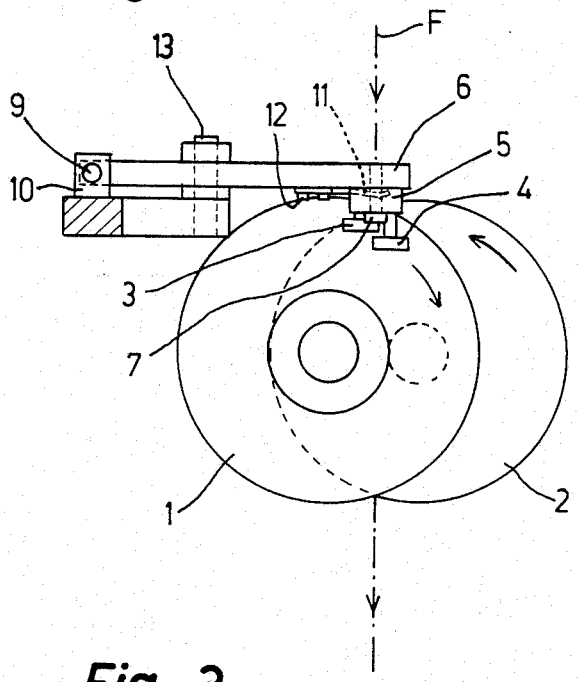
FIG. 1 shows a front view of a twist generator.
Figure 2:
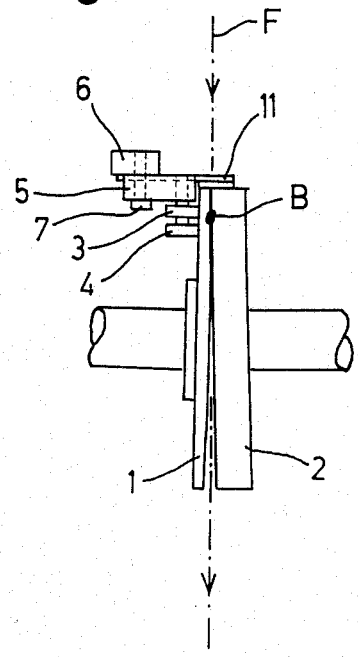
FIG. 2 shows a side view.

The twist generator illustrated, for a running fiber aggregate F, for example a yarn and/or a multifilament and/or a fiber slubbing, possesses in a known way two friction discs 1 and 2 which are rotatable in opposite directions and have end faces turned towards one another, which in the region of a thread contact point B touch and rotate the fiber aggregate F guided through between the discs 1 and 2. One friction disc 1 is made flexible; it is relatively thin and consists of elastomeric material, for example polyurethane. In contrast to this, the other friction disc 2 is practically rigid; it can consist of metal and simply have a friction lining (not shown) made of elastomeric material.

In the region of the thread contact point B, the flexible friction disc 1 is pressed by two pressure rollers 3 and 4 against the rigid friction disc 2 or against the fiber aggregate F running through between the two friction discs. In the direction of movement of the flexible friction disc 1, one pressure roller 3 is arranged shortly before the thread contact point B (that is to say, it touches the friction disc 1 shortly before the thread contact point B), whilst the other pressure roller 4 is arranged shortly after the thread contact point B.

The two pressure rollers 3 and 4 are rotatably mounted on a block-shaped carrier 5 which is in turn pivotably fastened, by means of a screw 7, to a spring-loaded element in the form of a lever 6. The lever 6 is pivotable about an axle 13 fixed to the machine stand. One end of a tension spring 8 engages on the other end of the lever 6, and the other end of the tension spring 8 is anchored to a screw 9 screwed into an extension 10 fixed to the machine stand.

The amount of pull of the spring 8 can be adjusted by turning the screw 9 in the extension 10. The lever 6 converts this pull into a pressure force which presses the carrier 5 fastened to the lever 6, and consequently the pressure rollers 3 and 4, in the direction of the flexible friction disc 1. As a result, the end face of the friction disc 1 is pressed against the fiber aggregate F and against the end face of the friction disc 2 in the region of the thread contact point B.

As already mentioned, the carrier 5 is pivotably fastened to the lever 6 by means of the screw 7. After the screw 7 has been slackened, the carrier 5 can be pivoted relative to the lever 6 about the axis of the screw 7, which is approximately parallel to the axes of the pressure rollers 3 and 4 and approximately perpendicular to the axes of the friction discs 1 and 2. The carrier 5 can then be fixed in any pivoting position by tightening the screw 7. The pivoting position of the carrier 5 relative to the lever 6 determines the distribution of the pressing force, generated by means of the spring 8, between the two pressure rollers 3 and 4.

To allow the two pressure rollers 3 and 4 to take effect as near as possible to the thread contact point B, they are, as illustrated, preferably arranged offset relative to one another in the direction of movement of the fiber aggregate F or in the direction of their axes.

Figure 3:
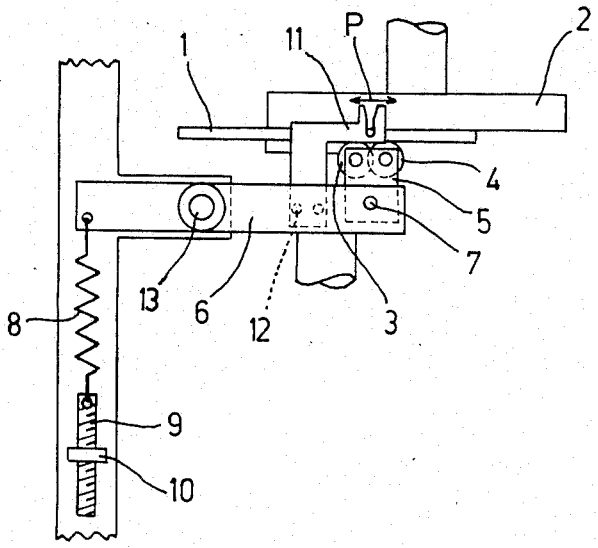
FIG. 3 shows a plan view relating to FIG. 1.

The twist generator also possesses a thread guide 11 which guides the running fiber aggregate F to the thread contact point B of the two friction discs 1 and 2. The thread guide 11 is arranged as near as possible to the thread contact point B, that is to say close up to the periphery of the friction discs 1 and 2. It can appropriately be fastened to the lever 6, for example by means of screws 12 which extend through slots (not shown) in the thread guide 11, so that the latter can be shifted transversely relative to the axis of the fiber aggregate F in line with the friction discs 1 and 2 (arrow P in FIG. 3).

What is claimed is:

1. In a twist generator for a running fiber aggregate, comprising two friction discs rotatable in opposite directions and having end faces turned towards one another for the twisting of the fiber aggregate running between the friction discs at a thread contact point, one of said friction discs being made flexible, pressure roll means in contact with said flexible friction disc for pressing the flexible friction disc towards the end face of the other friction disc; the improvement in which said pressure roll means comprises first and second pressure rollers in contact with said flexible friction disc respectively before and after the thread contact point of the friction discs in the direction of movement of said flexible friction disc, and means for adjusting the distribution of the total pressing force between the two pressure rollers.

2. A twist generator according to claim 1, wherein the two pressure rollers are carried by an element which is spring-loaded in the direction of the flexible friction disc, and are adjustable relative to this element to change the distribution of the total pressing force.

3. A twist generator according to claim 2, wherein the two pressure rollers are mounted next to one another on a carrier which is pivotably held on said spring-loaded element.

4. A twist generator according to claim 3, wherein said carrier can be fixed in any pivoting position relative to said spring-loaded element.

5. A twist generator according to claim 3, wherein the two pressure rollers are offset relative to one another in the direction of movement of the fiber aggregate.

6. A twist generator according to claim 2, wherein said spring-loaded element is a pivotably mounted lever.

7. A twist generator according to claim 2, further comprising means for adjusting the amount of the spring load of said spring-loaded element.

8. A twist generator according to claim 2, further comprising a thread guide attached to said spring-loaded element and arranged immediately next to the periphery of the two friction discs for guiding the fiber aggregate to the thread contact point of the friction discs.

9. A twist generator according to claim 8, wherein said thread guide is adjustable transversely relative to the direction of movement of the fiber aggregate in line with the friction discs.

10. A twist generator according to claim 1, further comprising a thread guide which is arranged immediately next to the periphery of the two friction discs for guiding the fiber aggregate to the thread contact point of the friction discs.

11. A twist generator according to claim 10, wherein said thread guide is adjustable transversely relative to the direction of movement of the fiber aggregate in line with the friction discs.

* * * * *